US011768034B2

(12) United States Patent
Andreae

(10) Patent No.: US 11,768,034 B2
(45) Date of Patent: Sep. 26, 2023

(54) INDUSTRIAL OVEN WITH FABRIC DUCT

(71) Applicant: SST Systems, Inc., Sturgeon Bay, WI (US)

(72) Inventor: Chad Martin Andreae, Sturgeon Bay, WI (US)

(73) Assignee: SST Systems, Inc., Sturgeon Bay, WI (US)

( * ) Notice: Subject to any disclaimer, the term of this patent is extended or adjusted under 35 U.S.C. 154(b) by 542 days.

(21) Appl. No.: 16/744,043

(22) Filed: Jan. 15, 2020

(65) Prior Publication Data

US 2021/0215427 A1 Jul. 15, 2021

(51) Int. Cl.

| | |
|---|---|
| ***F27D 7/04*** | (2006.01) |
| ***B05D 3/04*** | (2006.01) |
| ***F27B 9/28*** | (2006.01) |

(52) U.S. Cl.

CPC ..... *F27D 7/04* (2013.01); *B05D 3/0413* (2013.01); *F27B 9/28* (2013.01)

(58) Field of Classification Search

None

See application file for complete search history.

(56) References Cited

U.S. PATENT DOCUMENTS

| | | | | |
|---|---|---|---|---|
| 2,674,297 | A | 4/1954 | Greenwald | |
| 3,434,502 | A | 3/1969 | Snelling | |
| 4,670,994 | A * | 6/1987 | Takata | F26B 21/04 427/372.2 |
| 6,425,417 | B1 | 7/2002 | Paschke | |
| 6,527,014 | B1 * | 3/2003 | Aubourg | D04H 1/4218 138/DIG. 2 |
| 6,558,249 | B1 | 5/2003 | Anderson | |
| 6,769,909 | B2 * | 8/2004 | Schwartz | F27B 9/023 432/175 |
| 6,953,396 | B2 | 10/2005 | Paschke et al. | |
| 7,264,467 | B1 * | 9/2007 | Mitchell | F27B 17/0016 432/175 |
| 7,442,121 | B2 | 10/2008 | Cassidy et al. | |
| 9,152,191 | B1 | 10/2015 | Gardner | |

(Continued)

FOREIGN PATENT DOCUMENTS

CN 104307720 B * 1/2017

OTHER PUBLICATIONS

English Translation of CN-104307720-B (Year: 2017).*

(Continued)

*Primary Examiner* — Michael G Hoang
*Assistant Examiner* — Kurt J Wolford
(74) *Attorney, Agent, or Firm* — Michael Best & Friedrich LLP

(57) ABSTRACT

An industrial oven includes an oven chamber configured to receive a plurality of work pieces. A heater box of the oven has a heating element therein operable to heat air for delivery to the oven chamber. A circulation system of the oven is operable to force hot air from the heater box into the oven chamber. The circulation system includes a delivery manifold extending from the heater box to the oven chamber. A duct has an inlet coupled with an outlet of the delivery manifold, and the duct has a plurality of hot air outlet apertures therein for expelling hot air into the oven chamber. The duct is constructed of fabric sheet and suspended within the oven chamber.

9 Claims, 4 Drawing Sheets

(56) References Cited

U.S. PATENT DOCUMENTS

| | | | | |
|---|---|---|---|---|
| 9,494,336 | B2 | 11/2016 | Pinkalla et al. | |
| 9,709,193 | B2 | 7/2017 | Gebke et al. | |
| 9,909,251 | B2 | 3/2018 | Goodson | |
| 2007/0079884 | A1 | 4/2007 | Tomerlin et al. | |
| 2007/0292815 | A1* | 12/2007 | Klobucar | F27B 9/36 432/145 |
| 2015/0145153 | A1 | 5/2015 | Undgreen et al. | |
| 2019/0137180 | A1* | 5/2019 | Andreae | F26B 15/12 |

OTHER PUBLICATIONS

AvalonKing (Year: 2019).*
AvalonKing Accessibility Date (Year: 2022).*
Dürr (Year: 2018).*
Dürr Accessibility Date (Year: 2022).*
FibreGlast (Year: 2016).*
FibreGlast Accessibility Date (Year: 2022).*
Fibreglast, PTFE Coated Fiberglass (Year: 2016).*
Avalonking, the Truth about Powder Coating for Cars (Year: 2019).*
Duct Sox, Simple Sox Installation Guide (Year: 2010).*
Dürr, Pretreatment and Electrocoating (Year: 2018).*
"Suspension", Web page, FabricAir A/S, Jun. 19, 2019, Herfolge, Denmark, (2 pages), https://www.fabricair.com/en/suspensions.
"FabricAir Glass 220", catalog, FabricAir A/S, Herfolge, Denmark, (4 pages).

* cited by examiner

INDUSTRIAL OVEN WITH FABRIC DUCT

BACKGROUND

The present invention relates to industrial ovens, for example as part of a finishing system and processes for manufactured parts. A finishing process can include various forms of painting, whereby manufactured parts undergo electrophoretic deposition (e-coat) or powder coating. The coatings applied to manufactured parts may be cured in an industrial oven, for example a conveyor oven.

SUMMARY

In one aspect, the invention provides an industrial oven including an oven chamber configured to receive a plurality of work pieces. A heater box of the oven has a heating element therein operable to heat air for delivery to the oven chamber. A circulation system of the oven is operable to force hot air from the heater box into the oven chamber. The circulation system includes a delivery manifold extending from the heater box to the oven chamber. A duct has an inlet coupled with an outlet of the delivery manifold, and the duct has a plurality of hot air outlet apertures therein for expelling hot air into the oven chamber. The duct is constructed of fabric sheet and suspended within the oven chamber.

In another aspect, the invention provides an industrial coating system including a pretreat workstation for preparing a work piece surface for a coating, a paint application workstation for applying a paint coating to the work piece, and a cure oven. The cure oven has a heating element in a heater box, a work piece chamber separate from the heater box, and a circulation system interconnecting the heater box and the work piece chamber. The circulation system distributes hot air into the work piece chamber by a fabric duct suspended therein.

Other aspects of the invention will become apparent by consideration of the detailed description and accompanying drawings.

DETAILED DESCRIPTION

Figure 1:
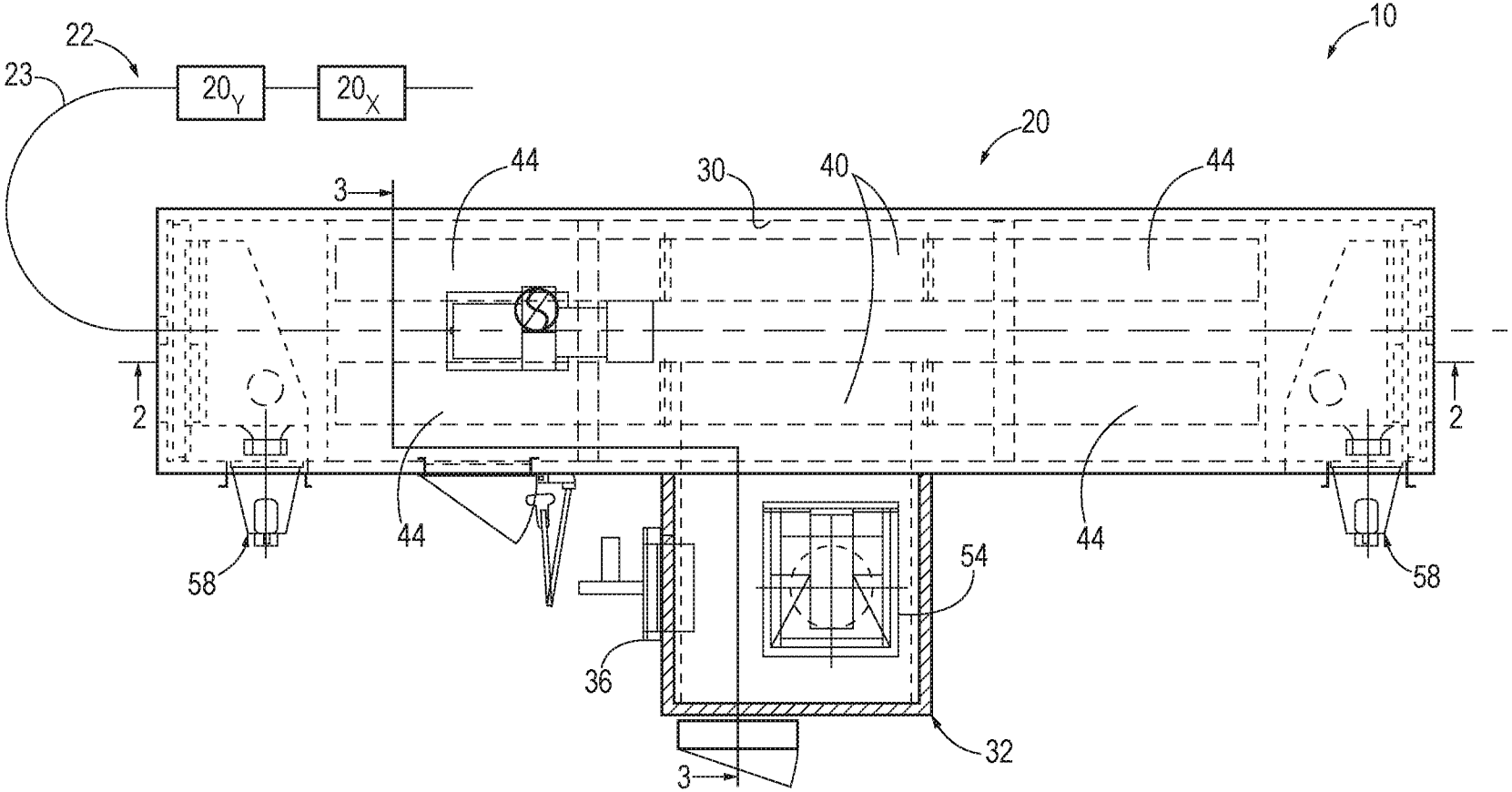
FIG. 1 is a plan view of an industrial oven according to one embodiment of the invention.
Figure 2:
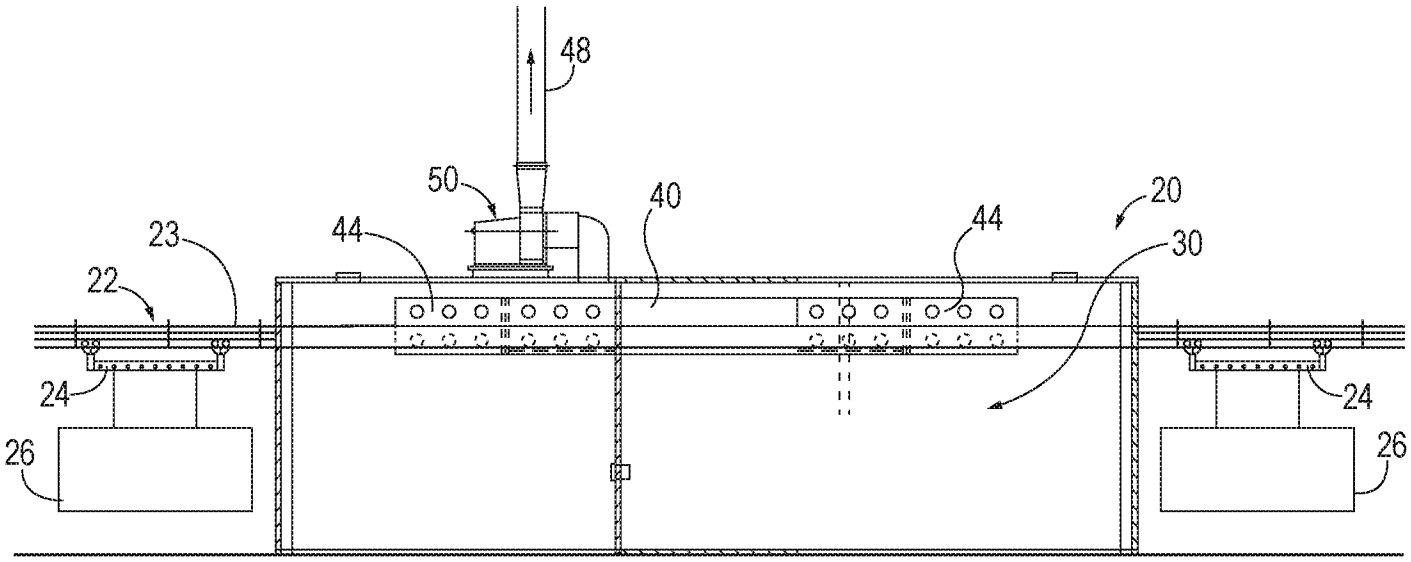
FIG. 2 is a cross-section of the industrial oven shown in FIG. 1, taken along line 2-2 of FIG. 1.

Before any embodiments of the invention are explained in detail, it is to be understood that the invention is not limited in its application to the details of construction and the arrangement of components set forth in the following description or illustrated in the accompanying drawings. The invention is capable of other embodiments and of being practiced or of being carried out in various ways.

As part of a finishing system 10 for applying finishes to manufactured components, an industrial oven 20 is provided downstream of one or more other workstations. A conveyor system 22 (e.g., an overhead conveyor including a conveyor rail 23 supporting carrier assemblies 24) is provided and operated to transport work pieces 26 through the finishing system, including through the oven 20. Each workstation of the finishing system is configured to perform a different manufacturing process, such as cleaning the work piece 26, applying a coating to the work piece 26, or curing the coating on the work piece 26. The oven 20 for example provides a coating curing workstation for curing a coating applied to the work pieces 26 at one or more upstream workstations. Molecules of the surface coating may be cross-linked during the curing. In other aspects, curing may refer to drying or baking a coating to achieve final or near final properties. In the illustrated example, the work pieces 26 can be cleaned or otherwise pretreated at one or more pretreat workstations 20*x* upstream of the oven 20, and the cleaned or pretreated work pieces 26 can receive a surface finish application (referred to generally as "paint") at one or more additional workstations 20*y* downstream of the pretreat workstation 20*x* and upstream of the oven 20. The paint workstation 20*y* can be an electrophoretic deposition (e-coating) workstation, or a powder coating workstation in some constructions. The first workstation 20*x* can be one of a plurality of pretreatment workstations. Pretreatment workstation(s) can include any one or more of: a media blasting workstation, a chemical cleaning workstation, a chemical (acid) etching workstation, and a rinse workstation. The workstations for the pretreatment and the finish application can take various forms, such as dip tanks, wash lines, and spray booths, for example.

The work pieces 26 can be consumer goods of metal, plastic, or wood onto which a coating of some type is applied as part of the finishing system prior to sale of goods to an intermediate or end user. The coating(s) may require a drying or curing process in order to properly ready the goods for final assembly, packaging, or sale. The coatings can be thermally cured coatings, which are heated in a cure oven, such as the oven 20, defining an oven chamber 30. The oven chamber 30 can be heated with steam, electrically generated heat, or a combustion-generated heat, although any number of alternate heat sources can also be utilized, including for example solar or geothermal energy. In the illustrated construction, the oven 20 includes a heater box 32 adjacent and adjoining the oven chamber 30. The heater box 32 defines a heat source chamber separate from the oven chamber 30. The heater box 32 includes a heating element 36, in some constructions a fuel-fired burner. Heated air from the heater box 32 is delivered to the oven chamber 30 through one or more manifolds 40 that extend to the oven chamber 30. Additionally, the heated air is distributed from the manifold 40 and released to the oven chamber 30 through one or more fabric ducts 44. Each fabric ducts 44 can have an inlet coupled to an outlet of the manifold 40. As such, the manifold(s) 40 define primary ducts that route heated air from the heater box 32 to the oven chamber 30, and the fabric duct(s) 44 define delivery ducts that disseminate the heated air into the oven chamber 30. As noted below, the manifold(s) 40 and the fabric duct(s) 44 form part of a circulation system within the oven 20.

Figure 4:
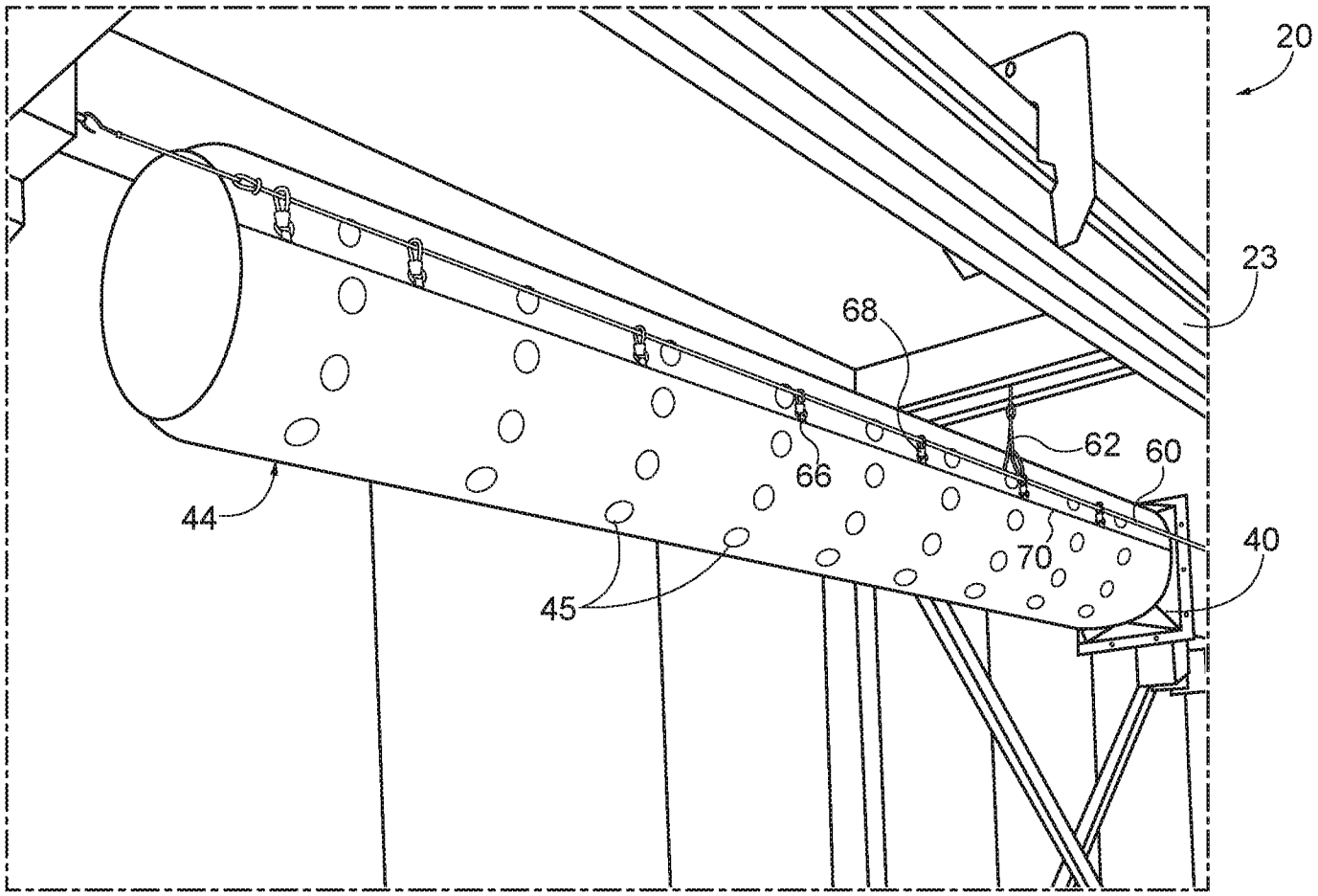
FIG. 4 is a perspective view of a fabric duct suspended within an oven chamber of the industrial oven.

Each fabric duct 44 can be constructed from a fabric sheet (e.g., fabric sheet sewn into a three-dimensional shape such as a tube). In the illustrated tubular construction, one end of the fabric duct 44 is a closed end. In order to output hot air from the heater box 32 to the oven chamber 30, each fabric duct 44 is provided with a plurality of hot air outlets 45 between the inlet and closed ends. The size, shape, and layout of the hot air outlets are designed to achieve the desired air delivery velocities and locations for the process, and may be tailored to a particular paint finish and/or work piece configuration. As shown in FIG. 4, the illustrated fabric duct 44 includes an array of outlets 45 at each of a plurality of lengthwise-dispersed intervals. In a given array (e.g., of four outlets 45), the outlets 45 may be spaced angularly at 30-degree intervals about a central axis of the fabric duct 44. All of the outlets 45 have the same shape (e.g., circular) and size, although size and shape among the outlets 45 may vary—either among different arrays at different lengthwise positions, or within a particular array. In some constructions, each of the outlets 45 has a diameter of 2 inches. The outlets 45 can be laser cut into the fabric. The duct or ducts 44 extend alongside the conveyor rail 23 such that the outlets 45 are directed laterally toward a conveyance plane P that extends vertically below the conveyor rail 23 between an inlet and an outlet of the oven chamber 30.

Figure 3:
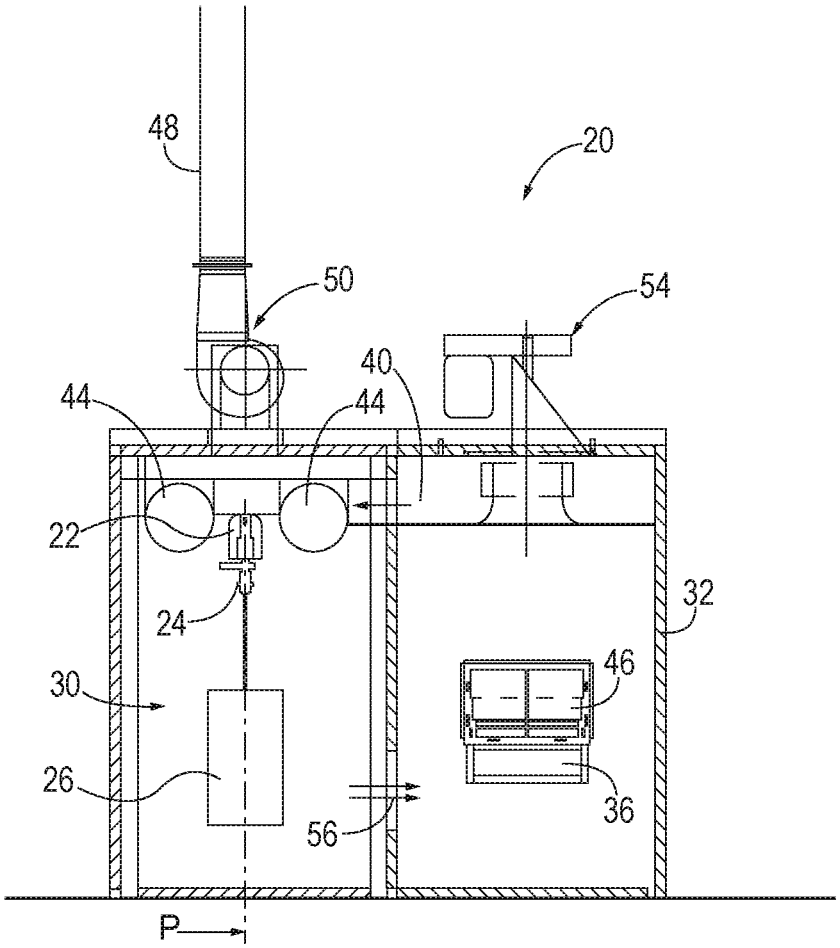
FIG. 3 is a cross-section of the industrial oven shown in FIGS. 1 and 2, taken along line 3-3 of FIG. 1.

Although the illustrated heater box 32 includes a make-up air inlet 46 for intake of fresh air, and an exhaust system (e.g., exhaust fan 50 provided to exhaust air through an exhaust stack 48), heated air is circulated between the oven chamber 30 and the heater box 32 through a circulation system. The circulation system includes a circulation fan 54 and a heated air return 56 (see FIG. 3) from the oven chamber 30 to the heater box 32. The heated air return 56 can optionally include one or more filters. Although one or more movable doors may be provided at the upstream and downstream ends of the oven 20 in some constructions, alternatively or additionally, an air seal is provided at each of the upstream and downstream ends of the oven 20. The air seal helps to contain heated air within the oven chamber 30, and inhibit the ingress of ambient air, for greater efficiency. The air seals can be provided by respective air seal fans 58. Additionally, it is noted that the walls defining the oven 20, including the oven chamber 30 and the heater box 32 can be constructed as thermally insulating walls, e.g., having multiple spaced material sheets separated by a layer of insulation.

As best shown in FIG. 4, the fabric duct 44 is suspended within the oven chamber 30. In particular, the fabric duct 44 is suspended from a cable 60 strung up within the oven chamber 30, e.g., between upstream and downstream end walls of the oven 20 and/or from a ceiling of the oven 20. FIG. 4 illustrates a ceiling tether 62 coupled to the oven ceiling and to a mid-span portion of the cable 60. The cable 60 can be a braided cable, single or multi-strand wire, or high-temperature rope for example. Furthermore, more than one cable 60 may be provided for suspending the fabric duct 44 (e.g., two cables 60 positioned laterally along two opposite sides of the fabric duct 44). The fabric duct 44 can include one or more attachment structures for connection with the cable(s) 60. As illustrated, the fabric duct 44 includes a plurality of radially-protruding loop members 66. The loop members 66 can be spaced apart at intervals along a length direction of the duct 44. In other constructions, the duct 44 may include a single continuous loop member that extends all or a majority of the length of the duct 44. The loop members 66 can receive the cable 60 directly (not shown), or indirectly through additional connectors, which can be provided as releasable connectors or latches 68 that can open and close for latching onto the cable 60 at any desired point along its length rather than requiring threading of the cable 60. The loop members 66, latches 68, and/or other attachment structures can be provided along a seam 70 of the duct 44. The seam 70 can be a lengthwise end-to-end seam along the duct 44.

In some constructions, the fabric for the duct 44 is woven in part or wholly with glass fibers. The loop members 66 can be constructed of fabric that is the same as or different from the primary fabric of the duct 44. The fabric is coated with PTFE (e.g., Teflon™) in some constructions. For example, PTFE coating can be applied to the woven fabric or to the individual fibers prior to weaving the fabric. In comparison to conventional sheet metal oven ducts, the fabric duct 44 is more cost effective to fabricate and install, continuously self-cleaning through vibration, and disposable/replaceable as opposed to requiring periodic deep cleaning.

What is claimed is:

1. An industrial oven comprising:

an oven chamber configured to receive a plurality of work pieces;

a conveyor system including a conveyor rail extending through the oven chamber, wherein a conveyance plane is defined to extend vertically below the conveyor rail between an inlet and an outlet of the oven chamber;

a heater box having a heating element therein operable to heat air for delivery to the oven chamber; and a circulation system operable to force hot air from the heater box into the oven chamber, the circulation system including a delivery manifold extending from the heater box to the oven chamber, a first duct having a first inlet coupled with a first outlet of the delivery manifold, and a second duct having a second inlet coupled with a second outlet of the delivery manifold, each of the first duct and the second duct having a plurality of hot air outlet apertures therein for expelling hot air into the oven chamber, wherein each of the first duct and the second duct is constructed of fabric sheet including glass fibers and coated with PTFE and is suspended within the oven chamber, wherein the first and second ducts extend in opposite directions from the delivery manifold to respective closed ends adjacent the inlet and the outlet of the oven chamber, and wherein both the first and second ducts extend alongside the conveyor rail and overlap the conveyor rail in side view, the plurality of hot air outlet apertures of each of the first and second ducts being directed laterally toward the conveyance plane.

2. The industrial oven of claim 1, wherein the first and second ducts extend along a first lateral side of the conveyor rail, the circulation system further comprising a third duct and a fourth duct, each of the third and fourth ducts: constructed of fabric sheet including glass fibers and coated with PTFE, extending along a second lateral side of the conveyor rail, and having a plurality of hot air outlet apertures directed laterally toward the conveyance plane, wherein the third and fourth ducts extend in opposite directions from the delivery manifold to respective closed ends.

3. The industrial oven of claim 1, wherein the circulation system includes at least one duct operable to recirculate at least a portion of the air from the oven chamber back through the heater box.

4. An industrial coating system including the industrial oven of claim 1, wherein the industrial finishing system includes, upstream of the industrial oven, both a work piece pretreat workstation and a paint application workstation for the plurality of work pieces, and wherein the industrial oven is configured as a curing workstation to cure paint applied to the plurality of work pieces at the paint application workstation.

5. The industrial coating system of claim 4, wherein the conveyor rail connects the work piece pretreat workstation, the paint application workstation, and the industrial oven and is operable to transport work pieces therebetween.

6. The industrial coating system of claim 4, wherein the paint application workstation is an e-coating workstation.

7. The industrial coating system of claim 4, wherein the paint application workstation is a powder coating workstation.

8. The industrial oven of claim 1, further comprising a cable spanning at least a portion of the oven chamber, wherein the first duct is suspended from the cable.

9. The industrial oven of claim 8, wherein the first duct is coupled to the cable with a plurality of latches.

* * * * *